US009144877B2

(12) United States Patent
Nakano

(10) Patent No.: US 9,144,877 B2
(45) Date of Patent: Sep. 29, 2015

(54) MACHINING METHOD AND MACHINING DEVICE OF COMPONENT

(71) Applicant: PANASONIC CORPORATION, Osaka (JP)

(72) Inventor: Shoji Nakano, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/210,133

(22) Filed: Mar. 13, 2014

(65) Prior Publication Data

US 2014/0287659 A1 Sep. 25, 2014

(30) Foreign Application Priority Data

Mar. 19, 2013 (JP) ..... 2013-056349
Feb. 6, 2014 (JP) ..... 2014-020935

(51) Int. Cl.
*B24B 21/00* (2006.01)
*B24B 29/02* (2006.01)

(52) U.S. Cl.
CPC ..... *B24B 21/008* (2013.01); *B24B 29/02* (2013.01)

(58) Field of Classification Search
CPC ..... B24B 37/042; B24B 1/00; B24B 7/228; B24B 21/04; B24B 27/0076; B24B 21/004; B24B 5/485; B24B 35/00; B24B 9/065; B24B 21/008
USPC ..... 451/57, 5, 168, 303, 444, 67
See application file for complete search history.

(56) References Cited

U.S. PATENT DOCUMENTS

| | | | | |
|---|---|---|---|---|
| 4,656,790 | A * | 4/1987 | Mukai et al. | 451/28 |
| 4,930,259 | A * | 6/1990 | Kobylenski et al. | 451/303 |
| 5,620,361 | A * | 4/1997 | Aylesworth | 451/59 |
| 5,820,446 | A * | 10/1998 | Lu | 451/37 |
| 5,868,857 | A * | 2/1999 | Moinpour et al. | 134/6 |
| 5,885,143 | A * | 3/1999 | Ichikawa et al. | 451/168 |
| 5,899,794 | A * | 5/1999 | Shige et al. | 451/41 |
| 6,193,590 | B1 * | 2/2001 | Weiss et al. | 451/163 |
| 6,592,435 | B2 * | 7/2003 | Kishima | 451/59 |
| 8,192,249 | B2 * | 6/2012 | Carter et al. | 451/41 |
| 2005/0238927 | A1 * | 10/2005 | Horie et al. | 428/846.9 |

FOREIGN PATENT DOCUMENTS

JP 56-102457 A 8/1981

* cited by examiner

*Primary Examiner* — George Nguyen
(74) *Attorney, Agent, or Firm* — McDermott Will & Emery LLP

(57) ABSTRACT

Machining of the present invention is machining of polishing work to be polished by movement of polishing sheet relative to work, in a state where polishing sheet is in contact with a surface of work to be polished. In the machining, work is arranged in contact with polishing sheet in a state where work is sandwiched between first simultaneous machining material with hardness lower than that of work, and second simultaneous machining material with hardness higher than that of work, and work is polished by relative movement of polishing sheet from first simultaneous machining material toward second simultaneous machining material.

9 Claims, 2 Drawing Sheets

MACHINING METHOD AND MACHINING DEVICE OF COMPONENT

RELATED APPLICATIONS

This application claim the benefit of Japanese Application No. 2013-056349, filed on Mar. 19, 2013 and Japanese Application No. 2014-020935, filed Feb. 6, 2014, the disclosures of which Applications are incorporated by reference herein.

BACKGROUND OF THE INVENTION

1. Field of the Invention

The present invention relates to a machining method and a machining device of a component for polishing a component to be polished by movement of a polishing material relative to the component to be polished.

2. Description of the Related Art

Unexamined Japanese Patent Publication No. S56-102457 discloses a method of grinding a component that is an aggregate of plate-like/rod-like bodies.

SUMMARY OF THE INVENTION

The present invention is a machining method of a component that is a machining method for polishing a component to be polished by movement of a polishing material relative to the component to be polished, in a state where the polishing material is in contact with a surface of the component to be polished, which includes: arranging the component to be polished in contact with the polishing material in a state where the component to be polished is sandwiched between a first simultaneous machining material with hardness lower than that of the component, and a second simultaneous machining material with hardness higher than that of the component; and polishing the component by relative movement of the polishing material from the first simultaneous machining material toward the second simultaneous machining material.

DETAILED DESCRIPTION OF THE PREFERRED EMBODIMENT

Hereinafter, a machining method and a machining device according to an exemplary embodiment of the present invention are described in detail suitably with reference to the drawings. However, excessively detailed description may be omitted. For example, detailed description of matters that are already well known, or redundant description for substantially the same configuration may be omitted. This is to avoid making the following description unnecessarily redundant, and to facilitate the understanding by a person skilled in the art.

The inventor provides the attached drawings and the following description in order that a person skilled in the art sufficiently understands the present invention, and does not intend to limit the subject matter recited in the scope of the claims by these.

1. Configuration

Figure 1:
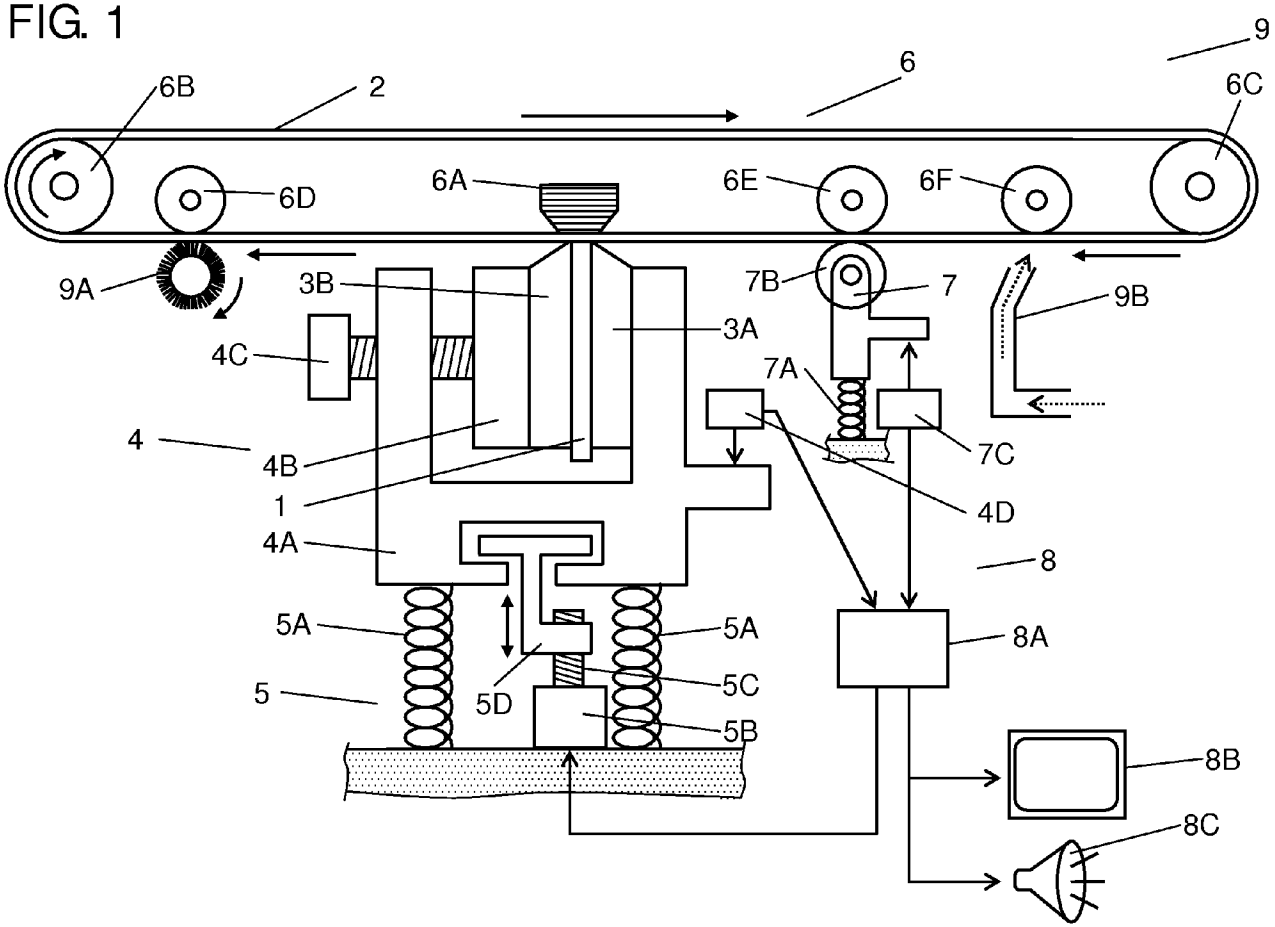
FIG. 1 is a configuration diagram showing a machining device for implementing a machining method according to an exemplary embodiment of the present invention.

FIG. 1 is a configuration diagram showing a machining device for implementing a machining method according to an exemplary embodiment of the present invention. The machining device shown in FIG. 1 polishes work 1 by the movement of polishing sheet 2 relative to work 1 in a direction of the arrow in FIG. 1, in a state where a surface of work 1 that is a component to be polished is in contact with polishing sheet 2 that is a sheet-like polishing material.

Work 1 to be polished has a recording surface that records information, and is arranged in contact with polishing sheet 2 in a state where work 1 is sandwiched between first simultaneous machining material 3A with hardness lower than that of work 1, and second simultaneous machining material 3B with hardness higher than that of work 1. First simultaneous machining material 3A is arranged in contact with the recording surface of work 1. Work 1 is, for example, a nickel plate with a height of 100 mm, a width of 100 mm, a thickness of 0.5 mm and Vickers hardness of about Hv 100. First simultaneous machining material 3A is, for example, a brass plate with a thickness of 5 mm, and Vickers hardness of about Hv 50. The polishing side end face of first simultaneous machining material 3A is obliquely machined such that a relief angle between polishing sheet 2 and first simultaneous machining material 3A is 5 degrees. Second simultaneous machining material 3B is, for example, stainless steel SUS304 with a thickness of 5 mm, and Vickers hardness of about Hv 150. The polishing side end face of second simultaneous machining material 3B is obliquely machined such that a relief angle between polishing sheet 2 and second simultaneous machining material 3B is 5 degrees.

Polishing sheet 2 is suitably selected depending on the kind or the required finishing accuracy of work 1. For example, as polishing sheet 2, waterproof paper of silicon carbide with roughness of No. 1200 can be used.

The machining device that polishes work 1 has holder 4 that holds work 1 in a state where work 1 is sandwiched between first simultaneous machining material 3A and second simultaneous machining material 3B, transition unit 5 that performs transition of the positional relation between the work and polishing sheet 2 between a contact state and a non-contact state, and driver 6 that moves polishing sheet 2 from first simultaneous machining material 3A toward second simultaneous machining material 3B. The machining device further has detector 7 that detects that adhering matter such as chips produced at the time of the polishing of work 1 and a falling polishing material coming from polishing sheet 2 is adhered to polishing sheet 2, and is configured such that controller 8 controls transition unit 5 to perform transition of the positional relation between polishing sheet 2 and work 1 to the non-contact state, in a case where detector 7 detects that adhering matter 10 is adhered to polishing sheet 2.

Polisher 9 configured from polishing sheet 2 and driver 6 includes rotary blush 9A and nozzle 9B for removing the adhering matter such as the chips produced at the time of the polishing of work 1 and the falling polishing material coming from polishing sheet 2.

Holder 4 includes frame 4A made of steel SK-3 or the like, which is a structural member for fixing work 1, clamp material 4B made of steel SK-3 or the like, which is movably held by frame 4A, and clamp screw 4C that is screwed into a screw hole provided in frame 4A and has a tip connected to clamp material 4B. Holder 4 holds work 1 by the fastening of clamp screw 4C such that work 1 is held while being sandwiched between first simultaneous machining material 3A and second simultaneous machining material 3B by frame 4A and clamp material 4B.

Holder 4 further has work position sensor 4D that measures the vertical position of frame 4A, and is configured such that the vertical position of work 1 can be measured by work position sensor 4D. As work position sensor 4D, for example, a noncontact displacement sensor that uses a laser beam can be used.

Transition unit 5 has springs 5A that urge holder 4 in a direction in which work 1 is pressed against polishing sheet 2, motor 5B, feed screw 5C, and moving member 5D. Motor 5B of transition unit 5 rotates feed screw 5C, so that moving member 5D is vertically moved. That is, transition unit 5 drives drive motor 5B, to perform operation of moving holder 4 in a direction opposite to the direction in which springs 5A urge holder 4, and separating work 1 from polishing sheet 2.

Driver 6 has guide member 6A that is arranged at a position opposite to work 1 via polishing sheet 2, rotary roller 6B that rotationally moves polishing sheet 2, and free roller 6C that applies predetermined tension to polishing sheet 2 together with rotary roller 6B to hold polishing sheet 2. Rotary roller 6B is driven by a motor (not shown), and rotary roller 6B rotationally moves annularly placed polishing sheet 2 like a conveyor, together with free roller 6C.

The surface of guide member 6A is accurately finished so as to be a flat surface in order to reliably polish the surface of work 1, so that polishing sheet 2 is held while maintaining a flat surface by guide member 6A. Work 1, first simultaneous machining material 3A, and second simultaneous machining material 3B held by holder 4 are accurately polished by the rotational movement of polishing sheet 2 in the direction of the arrow, while being pressed against a part of polishing sheet 2 supported by guide member 6A.

Driver 6 includes freely rotatable guide rollers 6D, 6E and 6F. Guide roller 6D is arranged at a position opposite to rotary blush 9A via polishing sheet 2. Guide roller 6E is arranged at a position opposite to detector 7 via polishing sheet 2. Guide roller 6F is arranged at a position opposite to nozzle 9B via polishing sheet 2.

Detector 7 has roller 7B that is pressed against polishing sheet 2 by spring 7A, and roller position sensor 7C that measures the vertical position of roller 7B. As roller position sensor 7C, for example, a noncontact displacement sensor that uses a laser beam can be used.

Controller 8 has control block 8A into which detection signals detected by work position sensor 4D and roller position sensor 7C are input, display 8B that performs predetermined display by a signal transmitted from control block 8A, and notification unit 8C such as a buzzer that notifies a worker with sound by a signal transmitted from control block 8A. Control block 8A controls the driving and the stop of motor 5B by the use of the detection signals from work position sensor 4D and roller position sensor 7C. That is, in a case where detector 7 detects that adhering matter is adhered to polishing sheet 2, transition unit 5 operates to perform transition of the positional relation between work 1 and polishing sheet 2 to a non-contact state.

Rotary blush 9A of polisher 9 contacts with polishing sheet 2, and rotates in the direction of the arrow by a motor (not shown). Nozzle 9B sprays compressed air supplied from a compressor (not shown), onto the whole surface in a width direction of polishing sheet 2. This removes the adhering matter such as the chips produced at the time of the polishing of work 1 and the falling polishing material coming from polishing sheet 2.

2. Operation

Description is made for the operation of the machining device for implementing the machining method according to the present invention, which is configured as described above.

First, work 1 to be polished is held by holder 4, while being sandwiched between first simultaneous machining material 3A with the hardness lower than that of work 1, and second simultaneous machining material 3B with the hardness higher than that of work 1, and is arranged so as to be pressed against the part of polishing sheet 2 supported by guide member 6A. Polishing sheet 2 is rotated in one direction from first simultaneous machining material 3A toward second simultaneous machining material 3B like a belt conveyer, by rotary roller 6B of driver 6, and polishes only in one direction. Consequently, first simultaneous machining material 3A with the hardness lower than that of work 1 suppresses the occurrence of burrs on the inlet side of work 1 without the occurrence of burrs on the outlet side of work 1, and second simultaneous machining material 3B with the hardness higher than that of work 1 suppresses the occurrence of burrs on the outlet side of work 1, so that an edge part on the inlet side (first simultaneous machining material 3A side) of work 1, and an edge part on the outlet side (second simultaneous machining material 3B side) of work 1 can be finished in a high sharpness state.

First simultaneous machining material 3A and second simultaneous machining material 3B are provided with predetermined relief angles with respect to contact surfaces with polishing sheet 2, and contact areas with polishing sheet 2 are reduced. Consequently, it is possible to suppress "chattering vibration" generated between polishing sheet 2 and work 1 when work 1 is polished by the relative movement of polishing sheet 2, and to prevent the deterioration of the machining accuracy of work 1. Furthermore, the relief angles are provided, so that the abrasion of polishing sheet 2 can be suppressed. Consequently, it is possible to enhance the efficiency of polishing.

Figure 2:
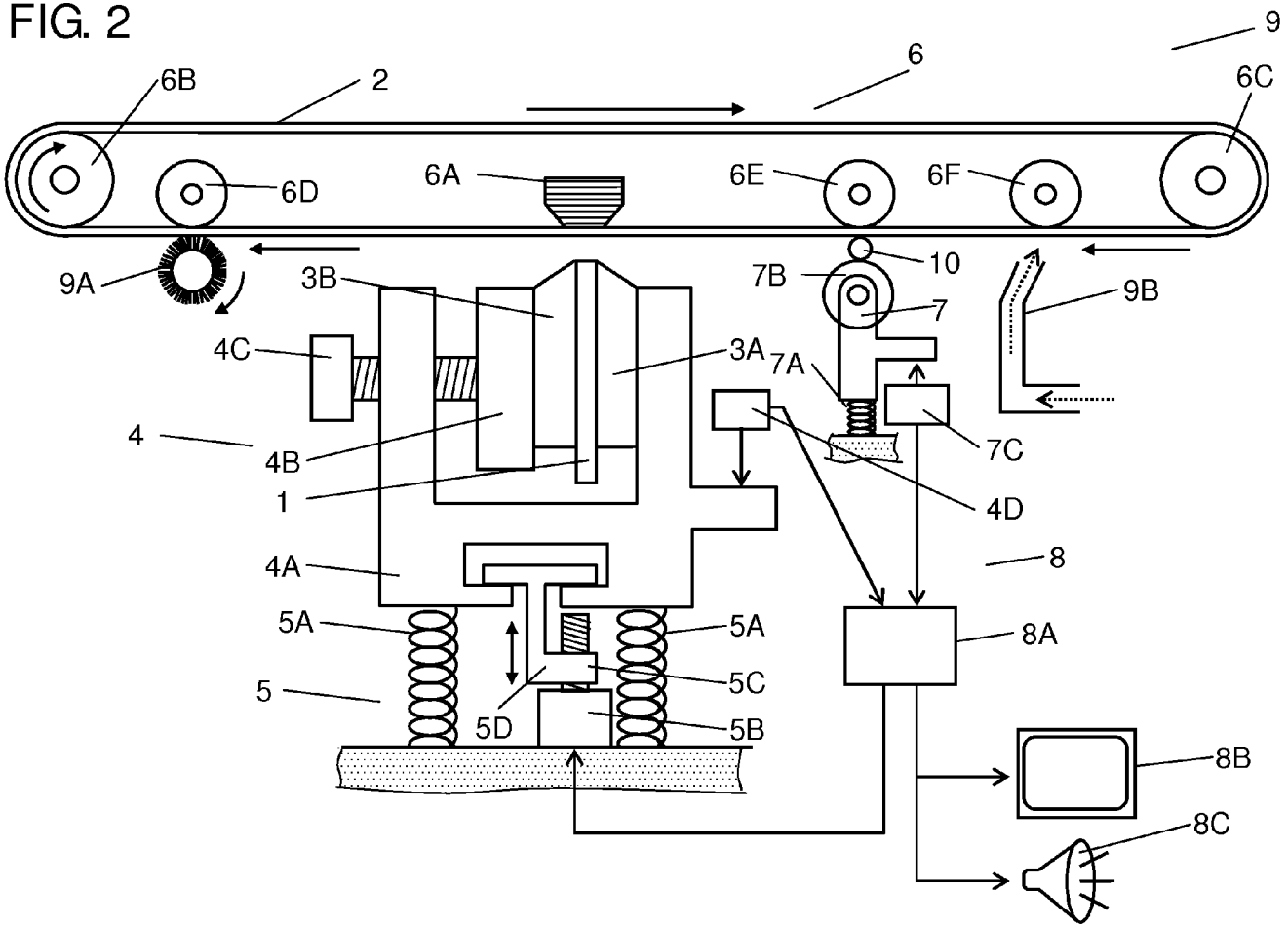
FIG. 2 is a configuration diagram for illustrating operation when adhering matter such as chips coming from a work and a falling polishing material coming from a polishing sheet is adhered to a polishing sheet, in the machining device for implementing the machining method according to the exemplary embodiment of the present invention.

FIG. 2 is a configuration diagram for illustrating operation when adhering matter such as chips coming from work 1 and a falling polishing material coming from polishing sheet 2 is adhered to polishing sheet 2, in the machining device for implementing the machining method according to the exemplary embodiment of the present invention. With reference to FIG. 2, the operation when the adhering matter such as the chips coming from work 1 at the time of the polishing and the falling polishing material coming from polishing sheet 2 is adhered to polishing sheet 2 is now described.

First, rotary blush 9A of polisher 9 contacts with polishing sheet 2, and rotates in the direction of the arrow by the motor (not shown), and nozzle 9B sprays compressed air supplied from the compressor (not shown), onto the whole surface in the width direction of polishing sheet 2. Consequently, it is possible to remove the adhering matter such as the chips produced at the time of the polishing of work 1 and the falling polishing materials coming from polishing sheet 2, while polishing is performed.

When the adhering matter such as the chips and polishing material that is adhered to polishing sheet 2 cannot be removed in the removal operation in which rotary blush 9A and nozzle 9B are used, roller 7B of detector 7 is displaced downward in FIG. 2, by adhering matter 10 adhered to polishing sheet 2, as shown in FIG. 2. Roller position sensor 7C detects that adhering matter 10 is adhered to polishing sheet 2 by the detection of this displacement of roller 7B. When receiving a detection signal from roller position sensor 7C, control block 8A of controller 8 rotates motor 5B such that moving member 5D of the transition unit is lowered. When moving member 5D is lowered, moving member 5D lowers holder 4 downward. By the lowering of holder 4, the contact state of work 1 and polishing sheet 2 is released, thereby enabling passing with no contact of adhering matter 10 with work 1. As a result, work 1 can be prevented from being heavily damaged due to the intervention of adhering matter 10 during the polishing.

The removal operation is again performed by the spray of compressed air by rotary blush 9A or nozzle 9B for adhering matter 10 that has passed. However, in a case where the adhering matter cannot be removed a certain number of times, control block 8A displays a message of "foreign matter removal is impossible" on display 8B, and issues an alert with notification unit 8C at the same time. In this case, the worker confirms polishing sheet 2, and manually remove adhering matter 10, or replaces polishing sheet 2 itself.

Furthermore, work position sensor 4D monitors whether or not the polishing is normally progressed, by the monitoring of the vertical position of work 1 during polishing. In a case where a constant amount of polishing is not progressed within preset time, control block 8A determines that clogging occurs in polishing sheet 2, displays a message of "clogging occurs" on display 8B, and issues an alert with notification unit 8C at the same time. With such a configuration, it is possible to suitably monitor the replacement time of polishing sheet 2, and always maintain polishing accuracy and polishing efficiency in good conditions.

As described above, according to the machining method according to the present invention, work 1 to be polished is held by holder 4 while being sandwiched between first simultaneous machining material 3A with the hardness lower than that of work 1, and second simultaneous machining material 3B with the hardness higher than that of work 1, and is arranged so as to be pressed against the part of polishing sheet 2 supported by guide member 6A. Polishing sheet 2 is configured to be moved in one direction from first simultaneous machining material 3A toward second simultaneous machining material 3B like a belt conveyer, by rotary roller 6B of driver 6.

Consequently, first simultaneous machining material 3A with the hardness lower than that of work 1 suppresses the occurrence of burrs on the inlet side of work 1 without the occurrence of burrs on the outlet side of work 1, and second simultaneous machining material 3B with the hardness higher than that of work 1 suppresses the occurrence of burrs on the outlet side of work 1, so that the edge parts of work 1 can be finished in a high sharpness state. Furthermore, it is possible to accurately and efficiently polish a work with large ductility.

First simultaneous machining material 3A and second simultaneous machining material 3B are provided with the predetermined relief angles with respect to the contact surfaces with polishing sheet 2, and the contact areas with polishing sheet 2 are reduced. Consequently, it is possible to suppress "chattering vibration" generated between polishing sheet 2 and work 1 when work 1 is polished by the relative movement of polishing sheet 2, and to prevent the deterioration of the machining accuracy of work 1. Furthermore, the relief angles are provided, so that the abrasion of polishing sheet 2 can be suppressed. Consequently, it is possible to enhance the efficiency of polishing.

In the aforementioned exemplary embodiment, the polishing sheet formed in a belt conveyor shape is described. However, the polishing sheet is not limited to this shape. Even a configuration in which a polishing sheet is attached to a surface plate with excellent plane accuracy, and a work is reciprocated to be polished only in one direction can obtain the same effects.

As described above, the exemplary embodiment has been described as an example of implementation of the present invention. Thus, the attached drawings and detailed description have been provided.

Therefore, in order to illustrate the implementation, not only essential elements for solving the problems but also elements that are not necessary for solving the problems may be included in elements appearing in the attached drawings or in the detailed description. Therefore, such unnecessary elements should not be immediately determined as necessary elements because of their presence in the attached drawings or in the detailed description.

Furthermore, since the exemplary embodiment described above is a merely example of the implementation, it is understood that various modifications, replacements, additions, omissions, and the like can be performed in the scope of the claims or in an equivalent scope thereof.

The present invention can accurately and effectively polish a component to be polished with large ductility, and is effective in machining of a component required for high accuracy.

What is claimed is:

1. A machining method for polishing a component, the machining method comprising:

arranging the component to be sandwiched between a first simultaneously-polished material with hardness lower than that of the component, and a second simultaneously-polished material with hardness higher than that of the component;

arranging a first surface to be polished of the component in contact with a polishing material, the first surface being different from surfaces of the component to which the first and second simultaneously-polished materials are contacted; and polishing the first surface of the component by relative movement of the polishing material in a direction from the first simultaneously-polished material toward the second simultaneously-polished material.

2. The machining method of a component according to claim 1, wherein the component has a recording surface configured to record information, and the first simultaneously-polished material and the second simultaneously-polished material are configured to sandwich the component therebetween such that the first simultaneously-polished material is in contact with the recording surface of the component, the recording surface being different from the first surface to be polished.

3. The machining method of a component according to claim 1, wherein the polishing material is sheet-like, and the first surface of the component is polished by moving of the sheet-like polishing material.

4. The machining method of a component according to claim 1, further comprising canceling a contact state between the polishing material and the first surface of the component in a case where adhering matter to the polishing material is detected during the machining of the component.

5. A machining device of a component, comprising:

a holder configured to hold a component to be polished in a state where the component to be polished is sandwiched between a first simultaneously-polished material with hardness lower than that of the component to be polished, and a second simultaneously-polished material with hardness higher than that of the component;

a first driver configured to move the holder that holds the components and the first and second simultaneously-polished materials to a polishing material such that a first surface to be polished of the component is in contact with the polishing material, the first surface being different from surfaces of the component to which the first and second simultaneously-polished materials are contacted; and a second driver configured to move the polishing material in a direction from the first simultaneously-polished material toward the second simultaneously-polished material, wherein the polishing material is moved in a state where the polishing material is in contact with the first surface of the component.

6. A machining device of a component comprising:

a holder configured to hold a component to be polished in a state where the component to be polished is sandwiched between a first simultaneously-polished material with hardness lower than that of the component to be polished, and a second simultaneously-polished material with hardness higher than that of the component; and a transition unit configured to perform transition of positional relation between the component and a polishing material between a contact state and a non-contact state, wherein in the contact state, a first surface to be polished of the component is in contact with the polishing material, the first surface being different from surfaces of the component to which the first and second simultaneously-polished materials are contacted;

a driver configured to move the polishing material in a direction from the first simultaneously-polished material toward the second simultaneously-polished material;

a detector configured to detect adhering matter to the polishing material; and a controller configured to control the transition unit such that the positional relation between the polishing material and the component changes to the non-contact state, in a case where the detector detects that the adhering matter is adhered to the polishing material, wherein the polishing material is moved in a state where the polishing material is in contact with the first surface of the component.

7. The machining device of a component according to claim 6, wherein the component has a recording surface configured to record information, and the first simultaneously-polished material and the second simultaneously-polished material are configured to sandwich the component therebetween such that the first simultaneously-polished material is in contact with the recording surface of the component, the recording surface being different from the first surface to be polished.

8. The machining device of a component according to claim 6, wherein the polishing material is sheet-like, and the first surface of the component is polished by movement of the sheet-like polishing material.

9. The machining method of a component according to claim 1, wherein, in the arranging the first surface in contact with the polishing material, part of the first and second simultaneously-polished materials are in contact with the polishing material.

* * * * *